US007672623B2

(12) United States Patent
Stelter et al.

(10) Patent No.: US 7,672,623 B2
(45) Date of Patent: Mar. 2, 2010

(54) ELECTROGRAPHIC DISTRIBUTED REPLENISHMENT APPARATUS AND METHOD

(75) Inventors: Eric C. Stelter, Pittsford, NY (US); James R. Flick, Rochester, NY (US); Joseph E. Guth, Holley, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 12/419,493

(22) Filed: Apr. 7, 2009

(65) Prior Publication Data

US 2009/0190961 A1 Jul. 30, 2009

Related U.S. Application Data

(62) Division of application No. 11/265,637, filed on Nov. 2, 2005, now Pat. No. 7,561,833.

(51) Int. Cl.
*G03G 15/08* (2006.01)

(52) U.S. Cl. ..... 399/258; 399/263

(58) Field of Classification Search ..... 399/57, 399/58, 62, 224, 233, 236, 263, 254–256, 399/258

See application file for complete search history.

(56) References Cited

U.S. PATENT DOCUMENTS

| | | | |
|---|---|---|---|
| 3,550,556 | A | 12/1970 | Chawda |
| 4,951,094 | A | 8/1990 | Bell et al. |
| 5,619,312 | A | 4/1997 | Hatano et al. |
| 5,657,115 | A | 8/1997 | Sugihara |
| 2004/0096242 | A1 | 5/2004 | Murakami |

FOREIGN PATENT DOCUMENTS

| | | |
|---|---|---|
| JP | 59 111661 | 6/1984 |

*Primary Examiner*—David M Gray
*Assistant Examiner*—Laura K Roth
(74) *Attorney, Agent, or Firm*—Donna P. Suchy

(57) ABSTRACT

A developer station and related method for distributed replenishment of toner as well as powder coatings and related materials. The developer station is divided into a first space adjacent or within a second space, the first space located adjacent a toner supply and the second space including a developer sump. The first space includes a toner-conveying device located in the first space, the toner-conveying device having a tapered body with a first end and a second end. A conveyance housing is located adjacent to and disposed such that the toner conveying device conveys the toner toward the developer sump as it travels from the first end of the toner conveying device to the second end of the toner conveying device, the housing having slots or openings so that the toner is deposited in the developer sump along the length of the conveying device.

12 Claims, 4 Drawing Sheets

ELECTROGRAPHIC DISTRIBUTED REPLENISHMENT APPARATUS AND METHOD

CROSS REFERENCE TO RELATED APPLICATIONS

This is a divisional application of U.S. Ser. No. 11/265,637 filed 2 Nov. 2005 now U.S. Pat. No. 7,561,833 entitled ELECTROGRAPHIC DISTRIBUTED REPLENISHMENT APPARATUS AND METHOD by Eric C. Stelter, James R. Flick and Joseph E. Guth, of which is assigned to Eastman Kodak Company.

FIELD OF THE INVENTION

The invention relates to electrographic printers and apparatus thereof. More specifically, the invention is directed to an apparatus and method for distributed replenishment of toner as well as powders for powder coatings and similar materials.

BACKGROUND OF THE INVENTION

Electrographic printers and copiers utilizing developer comprising toner, carrier, and other components use a developer mixing apparatus and related processes for mixing the developer and toner used during the printing process. The term "electrographic printer," is intended to encompass electrophotographic printers and copiers that employ dry toner developed on an electrophotographic receiver element, as well as ionographic printers and copiers that do not rely upon an electrophotographic receiver. The electrographic apparatus often incorporates an electromagnetic brush station or similar development station, to develop the toner to a substrate (an imaging/photoconductive member bearing a latent image), after which the applied toner is transferred onto a sheet and fused thereon.

As is well known, a toner image may be formed on a photoconductor by the sequential steps of uniformly charging the photoconductor surface in a charging station using a corona charger, exposing the charged photoconductor to a pattern of light in an exposure station to form a latent electrostatic image, and toning the latent electrostatic image in a developer station to form a toner image on the photoconductor surface. The toner image may then be transferred in a transfer station directly to a receiver, e.g., a paper sheet, or it may first be transferred to an intermediate transfer member (ITM) and subsequently transferred to the receiver. The toned receiver is then moved to a fusing station where the toner image is fused to the receiver by heat and/or pressure.

Development stations require replenishment of toner into the developer sump to replace toner that is deposited on the photoconductor or receiver. In development stations utilizing a carrier, this toner must be mixed uniformly with the carrier. Replenishment has been done at a single location in the developer sump, but this has lead to high concentrations of low-charge toner in one area of the sump, which tends to produce a dark streak on the image or receiver, or produces non-uniform areas in an image.

The present invention corrects the problem of non-uniform mixing. The apparatus and related methods transport and mix the toner efficiently when needed, maintaining the correct proportions necessary to produce the high quality prints or powder coatings required by consumer demand. The following invention solves the current problems with developer mixing so that the mixer will work in a wide variety of situations and with different types of toners, powders, or particles.

SUMMARY OF THE INVENTION

The invention is in the field of mixing apparatus and processes for electrographic printers and powder coating systems. More specifically, the invention relates to an apparatus and method for distributed replenishment of toner and powders, including toner in powder form as well as powder coatings and similar materials. The developer station is divided into a first space adjacent to, or within a second space, the first space located adjacent to a toner supply and the second space including a developer sump. Within the first space is a toner-conveying device, the toner-conveying device having a tapered body that includes a shaft and extensions and a first end and a second end. A conveyance housing is located adjacent to and is disposed such that the toner-conveying device conveys the toner evenly to the developer sump as it travels from the first end of the toner-conveying device to the second end of the toner-conveying device, the conveyance housing having slots or openings so that the toner is deposited in the developer sump. The opening can be a continuous opening, and the conveying device can consist of an open tube or tray.

DETAILED DESCRIPTION OF THE INVENTION

Figure 1:
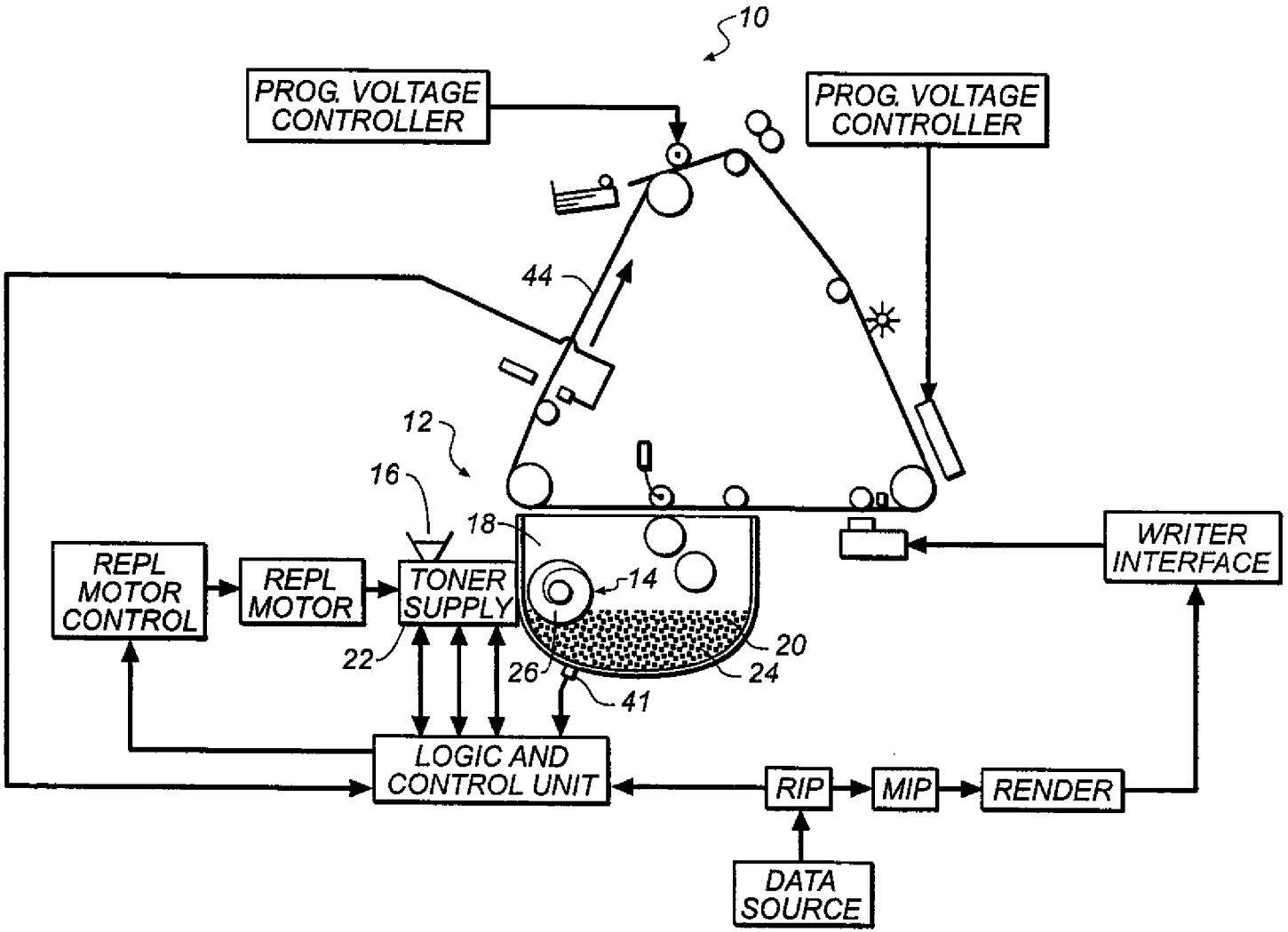
FIG. 1 presents a schematic view of a printer machine according to one aspect of the invention.

FIG. 1 shows a printer machine 10, such as an electrophotographic printer, with a developer station 12 for toner and magnetic carrier having a distributed replenishment apparatus or device 14 and a related method for distributed replenishment of toner 16 as well as powders such as powder coatings and similar materials that can be used in conjunction with a development station. The powder is meant to include any particulate matter including chemically prepared toner. The developer station 12 is divided into a first space 18 and a second space 20. The first space is located adjacent to a toner supply 22 and the second space includes a developer sump 24. The first space 18 includes a powder-conveying device, which will be hereafter referred to as a toner-conveying device 26, located in the first space.

Figure 2A:
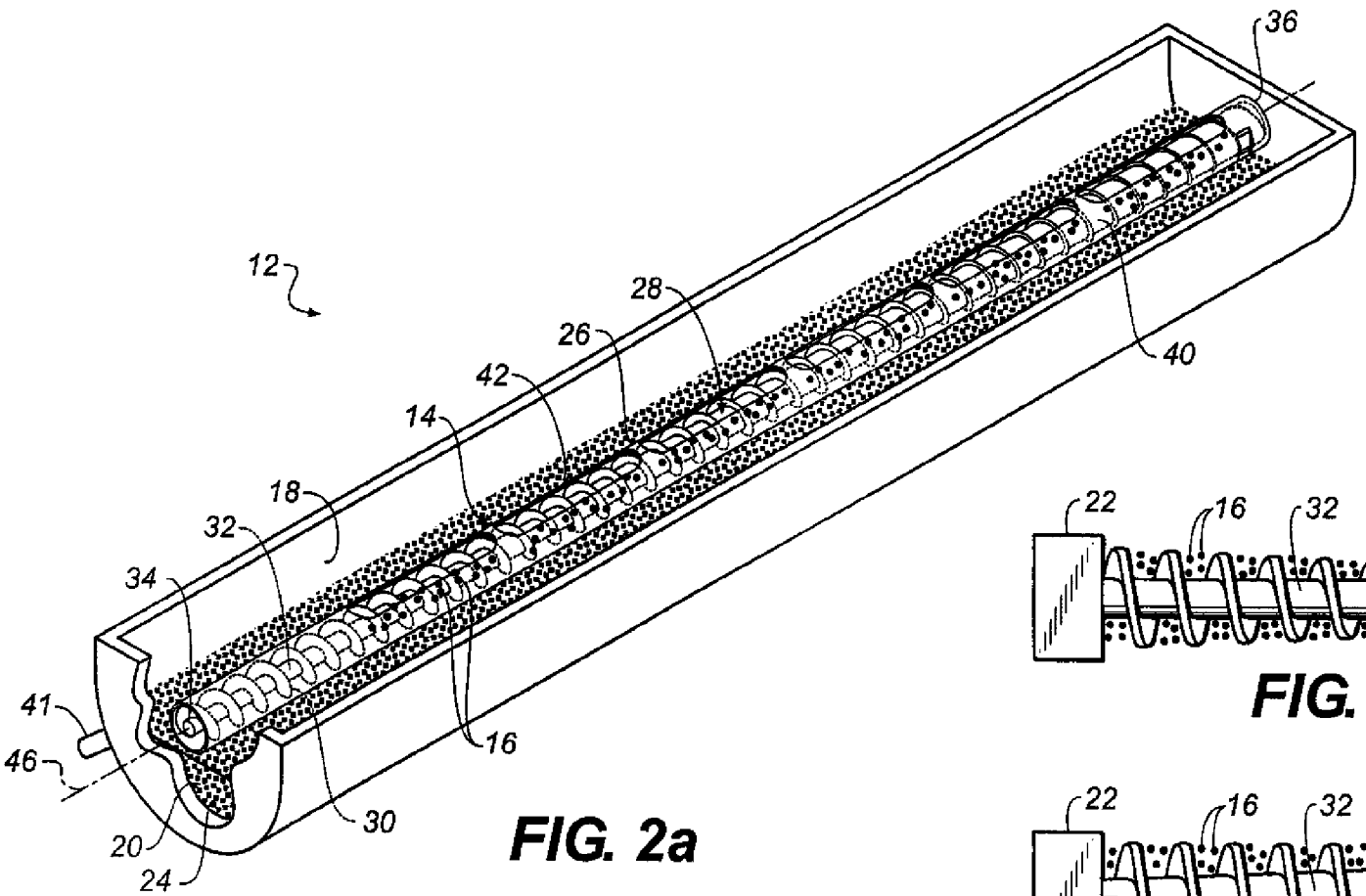
FIG. 2*a* is a cross-sectional top view of a distributed replenishment apparatus, according to one aspect of the invention, implemented as part of a developer station.

FIG. 2 shows the toner-conveying device 26 having a tapered body 28 with extensions 30 and a shaft 32. The toner-conveying device 26 has a first end 34 adjacent toner supply 22 and a second end 36. A conveyance housing 40 is located adjacent to and disposed such that the toner-conveying device conveys the toner toward the developer sump 24 as it travels from the first end of the toner-conveying device to the second end of the toner-conveying device. One or more sensors 41 may be located adjacent the conveyance housing 40 or the toner-conveying device 26 to sense various mixtures of toner and developer as required to control the distributed replenishment apparatus 14.

The housing has slots or openings 42 so that the toner is deposited in the developer sump 24 along the length of the toner-conveying device 26. The conveyance housing is shown cylindrical in bore but could have other shapes as one skilled in the art would understand, such as a tray with sides that could be curved or other shapes that allow the extensions to come within close proximity to the sides thus allowing the toner-conveying device to move toner from one end of the toner-conveying device to the second. The conveyance housing could also be a closed or open tube. The conveyance housing is shown with the axis of the conveyance housing being arranged approximately parallel to the axis of the toner-conveying device but it could be at a vertical or horizontal angle. For example, if a toner conveying device is used having a thread diameter with a decreasing taper, the housing could be a tray with a slanted bottom that fits the taper. The conveyance housing could also have a tapered or non-tapered shape.

The printer machine 10, shown in FIG. 1, includes a moving electrographic imaging or receiver member 44 such as a photoconductive belt. The term "electrographic printer," is intended to encompass electrophotographic printers and copiers that employ dry toner developed on an electrophotographic receiver element, as well as ionographic printers and copiers that do not rely upon an electrophotographic receiver. The processes of the present invention may also include a powder applicator for applying powder materials.

Electrographic printers typically employ a developer having two or more components, consisting of resinous, pigmented toner particles, magnetic carrier particles and other components. The developer is moved into proximity with an electrostatic image carried on an electrographic imaging member, whereupon the toner component of the developer is transferred to the imaging member, prior to being transferred to a sheet of paper to create the final image. Developer is moved into proximity with the imaging member by an electrically-biased, conductive toning shell, often a roller that may be rotated cocurrently with the imaging member, such that the opposing surfaces of the imaging member and toning shell travel in the same direction. In an electromagnetic brush toning station, a multipole magnetic core is located adjacent to the toning shell, having a plurality of magnets, that may be fixed relative to the toning shell or that may rotate, usually in the opposite direction of the toning shell. The developer is deposited on the toning shell and the toning shell moves the developer into proximity with the imaging member, at a location where the imaging member and the toning shell are in closest proximity, referred to as the "toning nip."

Referring now to FIG. 2, the distributed replenishment apparatus 14 is presented, according to one aspect of the invention, as part of an electrographic developer station 12. The developer station is shown divided into the first space 18 adjacent the second space 20 including the developer sump 24. The tapered body 28 with the shaft 32 and extensions 30 are disposed within the conveyance housing 40 such that the tapered body 28 is elongate along a first longitudinal axis 46 and acts as a mixing and conveying device. The tapered body can include helical or spiral portions spaced along the central longitudinal axis 46, and may have several possible forms, including a wire brush feeder, an auger-type feeder, beaters, a screw, a rotor or a plow with extensions that may be propeller-like, paddle-like, wheel-like or similarly shaped. The extensions can include threads, brushes, auger extensions, beater extensions, plow extensions, paddle extensions, propeller extensions, wheel extensions or similar type extensions.

The tapered body, upon rotation about the axis 46, moves toner 16 along the longitudinal axis 46 within the conveyance housing 40 proximate the second space and the toner is thus preferentially deposited into the developer sump 24. The tapered body 28 shown in FIG. 2*a* has both a tapered shaft 32 and tapered extensions 30 with evenly-spaced openings or slots 42 preferably at or near the top of conveyance housing 40 so that the toner is deposited in the developer sump along the length of the toner-conveying device. The conveyance housing 40 could also be a slotted housing, or the conveyance housing could have periodic openings, or openings that are not necessarily evenly spaced. A continuous opening along the length of the conveyance housing 40 can also be utilized.

Figure 2B:
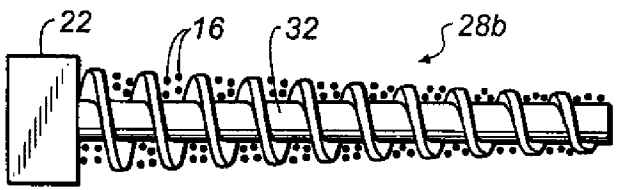
FIG. 2*b* is a cross-sectional side view of a portion of the distributed replenishment apparatus, according to one aspect of the invention, implemented as part of a developer station.
Figure 2C:
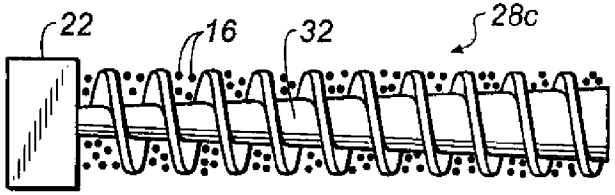
FIG. 2*c* is a cross-sectional side view of a portion of the distributed replenishment apparatus, according to one aspect of the invention, implemented as part of a developer station.

The tapered body 28*b* could have a non-tapered shaft 32 and tapered extensions, as shown in FIG. 2*b*, that are tapered to convey the toner 16 from the first end of the toner-conveying device to the second end of the toner-conveying device. In this case, the conveying housing 40 is similarly tapered. Alternately the tapered body 28*c* could have a tapered shaft 32 and non-tapered extensions, as shown in FIG. 2*c*. The tapered shaft should be tapered so that the larger diameter of the shaft is toward the second end of the tapered body so the tapered body would convey the toner 16 from the first end of the toner-conveying device to the second end of the toner-conveying device. In this case, conveying housing 40 has the shape of a regular geometric solid without a taper. Alternately the diameter of the tapered extension could be made to decrease from the first end of the toner-conveying device to the second end of the toner-conveying device, and the diameter or cross-section of the conveyance housing would be made to decrease from the first end of the toner-conveying device to the second end of the toner-conveying device.

The tapered body 28 can be constructed from a variety of materials and can take on a variety of shapes such as a screw with threads, or a brush with bristles. The materials for the extensions could be flexible material such as fiber brush, plastic tape, or rubber on a solid axis, or rigid materials and preferably made of same material as the shaft, such as aluminum, another metal, or hard plastic. The magnitude of the various pitches may vary to optimize the conveyance of the toner 16 from the first end of the toner-conveying device to the second end of the toner-conveying device and also the continuous mixing of the toner. According to a preferred embodiment, the magnitudes of pitches are approximately equal to the average thread diameter of the tapered body, but can vary from 0.1× to 10× of the average magnitude of the thread diameter. Thread diameter and shaft speed are chosen to provide sufficient toner to replace toner removed by development. For example, a printer producing 100 8½ inch by 11 inch pages per minute with printed coverage of approximately 10% on average at 1 mg/cm$^2$ of toner coverage requires approximately 6 g/min of toner. For toner of density approximately 1 g/cm$^3$ packed loosely at 0.6 packing fraction, this corresponds to approximately 10 cm$^3$ of toner per minute. A powder-conveying device with a shaft speed on average of 60 RPM needs to deliver at least ⅙ cm$^3$ of toner per revolution, requiring a volume of ⅙ cm$^3$ per thread. For initial thread diameter D in cm and an axis of initial diameter 0.5 cm, the volume V available for toner at the first end of the powder-conveying device is $$V = \pi D\left(\left(\frac{D}{2}\right)^2 - \left(\frac{0.5}{2}\right)^2\right)$$

For V=⅙ $cm^3$, D=0.73 cm. The extension or thread diameter D and shaft axis diameter relationship can vary along the longitudinal axis of the powder-conveying device in accordance with this invention to deposit an approximately equal volume of toner in the sump per unit length of conveyance housing. This can be done by changing either thread diameter or shaft diameter or both. It is understood that those skilled in the art can adapt this type of calculation to different circumstances, including devices that run at variable speed or that run intermittently under machine control using toner concentration sensors 41 to compensate for variable toner consumption, for example. All of these variations are considered to fall within the purview of the invention.

Rotation of the toner-conveying device 26 is implemented using gears, pulleys, chains, belts, direct drive, variable drive etc. using a motor disposed on the outside of the conveyance housing attached to the shaft of the toner-conveying device having a tapered body and a conveyance housing. One skilled in the art would understand that one or more of either toner-conveying devices having a tapered bodies and conveyance housings could be similarly controlled. It is also known by one skilled in the art how to make and use a variable speed device that could be used to control one or more toner-conveying device having a tapered body and a conveyance housing.

Figures 3A, 3B:
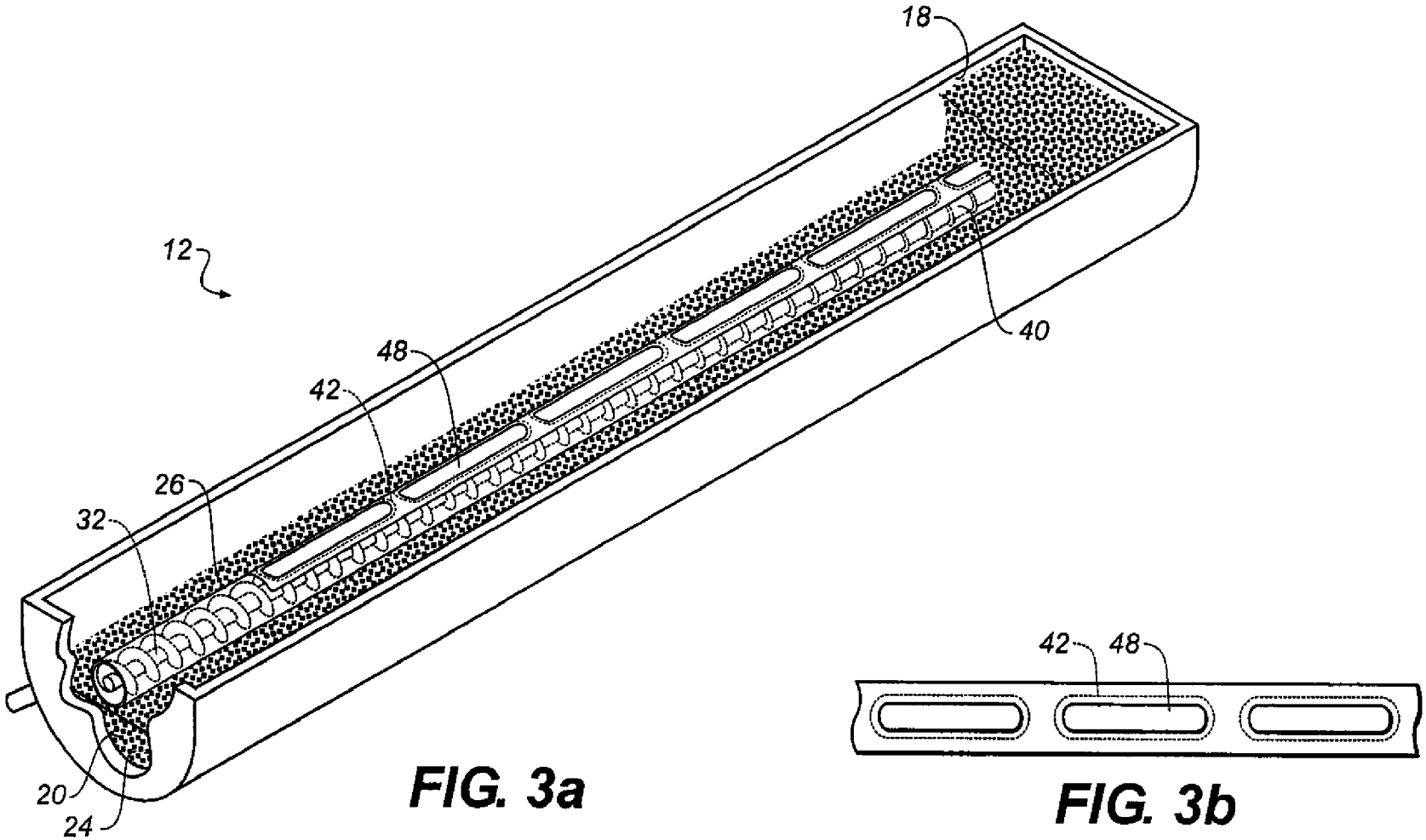
FIG. 3*a* is a cross-sectional top view of a second embodiment of the distributed replenishment apparatus.
FIG. 3*b* is a side view of one or more flaps.

FIG. 3 shows the tapered device 26 with the developer station divided into the first space 18 within the second space 20 and also within the developer sump 24 so that there is developer around the openings 42. The openings 42 are shown at or near the top of the conveyance housing with one or more flaps 48, shown schematically in FIG. 3*a*, over the openings. The flaps allow toner to be pushed out but do not allow the developer to flow into the conveyance housing 40. This allows toner to be replenished from within the developer in the development sump, reducing dust from potentially airborne toner particles. The openings and associated flaps could be arranged in a variety of formations including linearly along a horizontal line or staggered. One skilled in the art would understand that the use of one or more flaps could also make it possible to place any slots or openings near or at the bottom of the conveyance housing.

Figure 4:
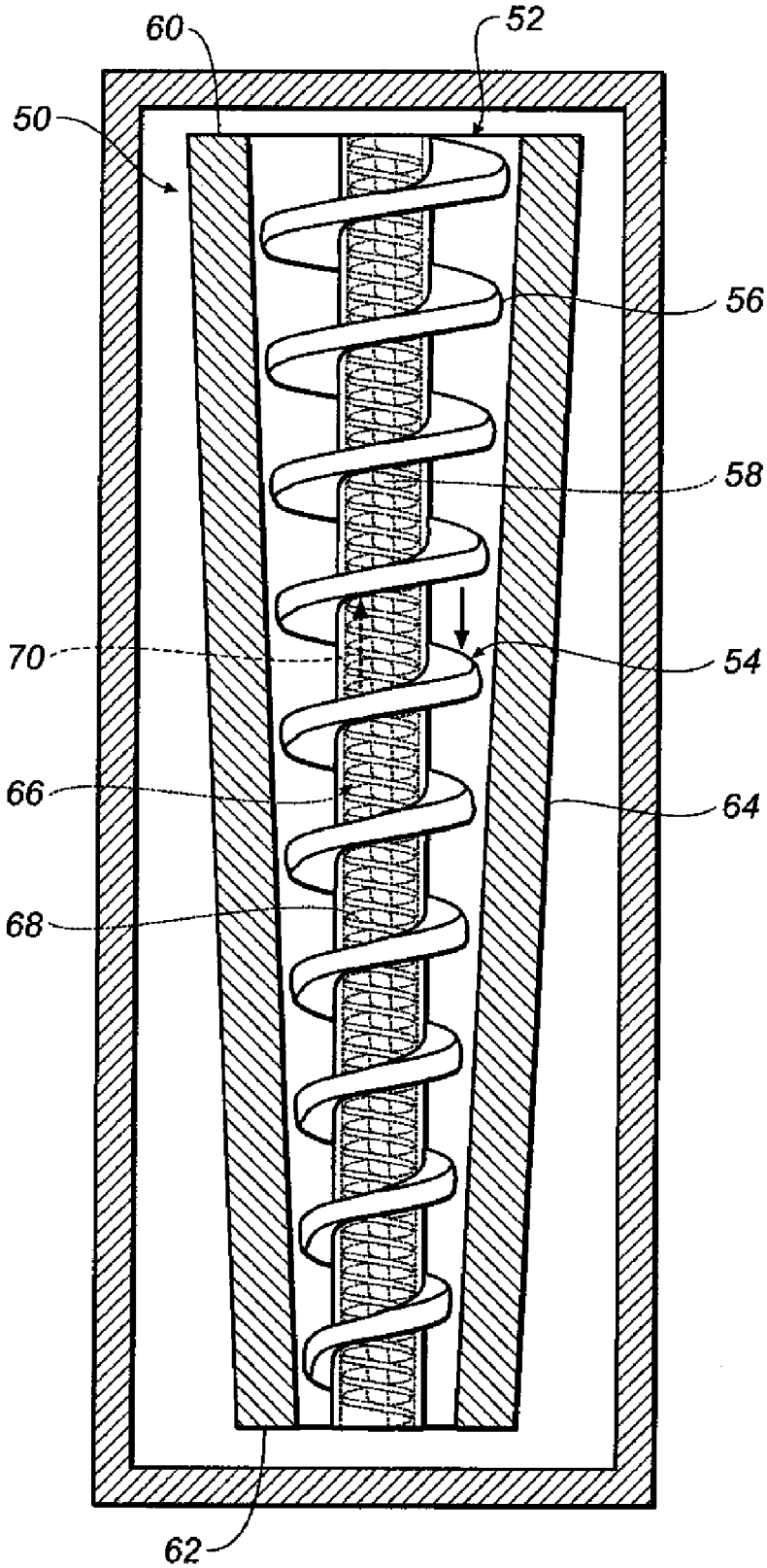
FIG. 4 is a schematic top view of an embodiment of the distributed replenishment apparatus.

FIG. 4 shows a distributed replenishment apparatus 50 according to another aspect of the invention. The apparatus 50 includes a toner-conveying device 52 having a tapered body 54 with extensions 56 and a shaft 58 as is described above. The conveying device 52 has a first end 60 and a second end 62 and is seated in a conveyance housing 64. Additionally the distributed replenishment apparatus 50 has an inner conveyance device 66 that has extensions 68 that are capable of conveying any extra toner that was not conveyed to the developer sump back to the first end 60 as indicated by inner directional 70. Examples of the types of inner conveyance devices are of the type described in a co-pending application Ser. No. 11/217,916.

Numerous combinations are possible in the practice of the present invention. The tapered toner conveyance device has the tapered body described above and can take many shapes, including a wire brush feeder, an auger-type feeder, beaters, a screw, a rotor or a plow with extensions that may be propeller-like, paddle-like, wheel-like or similarly shaped, and the conveyance housing can take many shapes, including a slotted tube, open tube, or tray. This can greatly improve the homogeneity of toner concentration in the developer mix and resulting homogeneity of toner density of a developed electrostatic image on an electrographic substrate, film, media, or belt. The invention has been found to eliminate a strip of greater toner density in a developed electrostatic image.

The processes of the present invention may also include a powder applicator for applying powder materials. It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. While various elements may have been described as being implemented by software, in other embodiments hardware or firmware implementations may alternatively be used, and vice-versa. Similarly, the controllers may implement software, hardware, and/or firmware. In view of the wide variety of embodiments to which the principles of the present invention can be applied, it should be understood that the illustrated embodiments are exemplary only, and should not be taken as limiting the scope of the present invention.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof.

What is claimed is:

1. An apparatus for transporting toner into a developer station containing at least toner and magnetic carrier comprising:

a. a developer station first space and second space, including a developer sump, such that the first space is adjacent to both the second space, and a toner supply;

b. a toner-conveying device located in the first space, the toner-conveying device having a tapered body with a first end and a second end; and c. a conveyance housing having periodic openings with flaps over the openings disposed such that the toner-conveying device conveys the toner toward the developer sump as the toner travels from the first end of the tapered body to the second end of the tapered body so that the toner is deposited in the developer sump along the length of the conveying device.

2. The apparatus of claim 1, the tapered body further comprising a tapered shaft with a non-tapered extension, a diameter of the tapered shaft increasing from the first end of the powder conveying device to the second end of the powder conveying device.

3. The apparatus of claim 2, the extensions further comprising one or more of a thread, a brush, auger extension, beater extension, plow extension, paddle extension, propeller extension, or wheel extension.

4. The apparatus of claim 1, the tapered body further comprising a tapered shaft with a tapered extension, a diameter of the tapered shaft increasing from the first end of the powder conveying device to the second end of the powder conveying device, and a diameter of the tapered extension decreasing from the first end of the powder conveying device to the second end of the powder conveying device.

5. The apparatus of claim 1 further comprising a tapered shaft with non-tapered extensions in a non-tapered conveyance housing.

6. The apparatus of claim 1 further comprising a tapered extension with a tapered shaft in a tapered conveyance housing.

7. The apparatus of claim 1, the tapered body further comprising extensions that include helical or spiral portions spaced along the tapered body.

8. The apparatus of claim 1 further comprising an extension diameter to shaft diameter relationship along the longitudinal axis of the powder-conveying device so that a volume of space for powder between extensions has an approximately equal volume of powder to be deposited in the developer sump.

9. The apparatus of claim 1, the conveyance housing further comprising a tapered body axis being arranged about parallel to an axis of the powder-conveying device.

10. The apparatus of claim 1 further comprising the conveyance housing that is cylindrical in bore.

11. The apparatus of claim 1 wherein the first space is above the second space and separated by a distance.

12. The apparatus of claim 1 further comprising the toner conveying device made of a flexible material from a group including a fiber brush, plastic tape, or rubber on a rigid axis, or rigid and preferably made of same material as the tapered body, such as aluminum, another metal, or hard plastic.

* * * * *